US005683208A

United States Patent [19]

Fage et al.

[11] Patent Number: 5,683,208

[45] Date of Patent: Nov. 4, 1997

[54] GRANULAR MATERIALS AND METHOD OF SOIL REINFORCEMENT

[75] Inventors: Jean-Louis Fage, Boulogne; Claude Choudin, Saint-Jean-D'Arvey; Jean-Baptiste Rieunier, Nogent-sur-Oise; Jean-Marc Letalenet, Bury, all of France

[73] Assignee: Orgel, Courbevoie, France

[21] Appl. No.: 549,787

[22] PCT Filed: Jun. 1, 1994

[86] PCT No.: PCT/FR94/00643

§ 371 Date: Mar. 7, 1996

§ 102(e) Date: Mar. 7, 1996

[87] PCT Pub. No.: WO94/28248

PCT Pub. Date: Dec. 8, 1994

[30] Foreign Application Priority Data

| | | | |
|---|---|---|---|
| Jun. 2, 1993 | [FR] | France | 93 06602 |
| Jun. 22, 1993 | [FR] | France | 93 07563 |
| Apr. 15, 1994 | [FR] | France | 94 04489 |

[51] Int. Cl.[6] ..... C09K 17/00; E01C 7/36; E01C 21/00

[52] U.S. Cl. ..... 405/263; 404/76

[58] Field of Search ..... 405/258; 263; 404/75, 76

[56] References Cited

U.S. PATENT DOCUMENTS

| | | | |
|---|---|---|---|
| 3,861,926 | 1/1975 | Irlam et al. | 106/50 |
| 4,867,614 | 9/1989 | Freed | 405/263 |

FOREIGN PATENT DOCUMENTS

| | | |
|---|---|---|
| 2368211 | 10/1976 | France . |
| 040145 | 11/1981 | France . |
| WO 91/17311 | 11/1991 | France . |

*Primary Examiner*—Tamara L. Graysay
*Assistant Examiner*—Tara L. Mayo
*Attorney, Agent, or Firm*—Oblon, Spivak, McCelland, Maier & Neustadt, P.C.

[57] ABSTRACT

A material intended to form grounds, layers or sublayers of terrains or of carriageways.

It contains an ungraded granulated material such as sand or pulverulent materials of industrial origin to which bundles of glass filaments are added in a proportion from 0.01 to 0.1%.

19 Claims, 3 Drawing Sheets

GRANULAR MATERIALS AND METHOD OF SOIL REINFORCEMENT

BACKGROUND OF THE INVENTION

1. Field of the Invention

The invention relates to techniques for making up grounds in which sands or granular substitute materials are used; it relates in particular to the production of sublayers of tracks, roads or sports terrains.

2. Discussion of the Background

When a road is created on a new ground, various steps are carried out, the first consisting in levelling the ground with machines such as bulldozers which flatten the projecting parts and fill up the holes. The second phase consists in depositing on the ground thus prepared a subgrade, the first function of which will be to allow movement of the convoys and machines over the ground while preventing it being damaged or the machines becoming bogged down. Next, onto the subgrade are deposited one or more other layers of different type, called foundation course, base course, etc., the common role of which is to support the layers closer to the surface which are bound by large quantities of hydraulic or bituminous binders.

SUMMARY OF THE INVENTION

Each of the subjacent layers is produced with a sand of well-defined quality which, unfortunately, in general, is not available in the vicinity of the site. Although the cost of such a material is not high, its transport may turn out to be very expensive.

One of the objects of the invention is to make it possible to use, for the production of subjacent layers, materials, in particular sand coming from pits near the site, to which fibres are added which give them the desired properties.

Another object of the invention is to improve the contribution of the subjacent layers to the stability of the road and to the integrity of the carriageway over time.

Likewise, in the field of land development, in order to prepare it for a new purpose such as, for example, in order to create a track, a sports terrain or a racecourse, in which the ground is first levelled by bulldozers, in the following step not only sand of defined particle size distribution but also modified ungraded materials may be brought in as new material.

It is also an object of the invention to enable the most varied of ungraded materials to be modified in order to enable them to be adapted as constituents of a subjacent layer which prepare the levelled ground for a new function, such as the use as a track, as a sports terrain, operating site, racecourse, etc.

Likewise the invention has to enable damaged roads to be repaired by reusing the granulates already in place or bringing in new powders or granulates.

The object of the invention is also to propose a product allowing reinforcement which is compatible with the usual additives to sand, such as hydraulic binders.

It is known, in particular from Patent Application WO 91/17311, to add, to fine sand of particle size defined by the ratio d/D in which d corresponds to the particles of small diameter and D to the particles of larger diameter, this sand satisfying the relationships d=0 and D<=6 mm, synthetic fibres in a quantity approximately lying between 0.2 and 5 per thousand by weight, preferably between 0.5 and 1 per thousand.

The synthetic fibres have a length from 15 to 100 mm and their diameter lies between 30 and 100 μm. Fibres made from various materials are mentioned, the examples relating to polyacrylonitrile fibres.

The invention, by virtue of the choice of a suitable material and of the use of novel methods for incorporating the fibres into the inorganic granulates provides a product which is of superior quality, easier to employ and, taking everything into account, less expensive.

Techniques are also known for fixing sandy terrains in which a textile filamentary network, produced from at least one cable of continuous yarns, is incorporated into the sand. Thus, Patent Application FR-A-2,368,211 proposes adding a cable of 27,000 or 100,000 crimped filaments made of polyvinyl chloride, acrylonitrile or viscose in sand in order to stabilize dunes and to seed them. In this case, this is essentially to stabilize embankments and to limit wind erosion.

The invention has been developed for a different purpose, namely to stabilize grounds intended to support localized loads, like those due to trampling or being driven over by machines, while the upper layers are being installed and consequently to ensure stable support of the terrain or of the road constructed; the means proposed are also different.

The invention proposes a granular or pulverulent material intended for the production of grounds, terrain or carriageway layers or sublayers and including a mix based on inorganic or organic powders or granulates and on fibres, in which material the fibres are filaments in the form of bundles having a length less than 100 mm, especially inorganic fibres, in particular glass fibres with bundles consisting of at least 40 filaments, each having an individual diameter lying between 5 and 25 μm. Preferably, the bundles have a length lying between 20 and 50 mm.

According to the invention, the amount by weight of the filament bundles in the mix lies between 0.01% and 0.5% and preferably between 0.01 and 0.1%. They are preferably cut from textile glass yarns, the filaments of which have a diameter lying between 10 and 16 μm, such as 11 or 14 μm. The powder, to which the glass filaments are added, advantageously essentially comprises industrial by-products, such as fly ash or slag, whereas the granulates are sand to which a variable quantity of hydraulic binder may be added. The invention also provides for the granulates to be sand-grit particles treated with hydraulic binders.

In a variant, the glass filaments are based on an alkali-resistant composition.

The granular material according to the invention allows production of grounds, terrain or carriageway layers or sublayers which have, compared to known fibre-filled pulverulent materials, the advantage of at least equivalent performance despite small quantities of fibres.

The invention also relates to a method for making up a mix of inorganic granulates and glass fibres which is intended to form a subgrade for carriageways; it includes the following steps which are linked together in succession or are carried out simultaneously:

- deposition of a layer of granulates onto a transporter;
- deposition, by gravity, onto the previous layer, of filament bundles which have been obtained by cutting at least one roving of textile glass yarns;
- possibly covering of the filament bundles by a layer of granulates;
- and, finally, mixing the granulates with the filament bundles.

In a variant, the process of the invention provides for the filament bundles to be deposited directly onto the levelled ground, consisting of inorganic or organic powders or granulates and for the mixing of the filament bundles with the powders or granulates to be carried out by the passage of a work-site machine of the rotary-cultivator type, the distribution advantageously being carried out by a work-site machine of the sowing type. The process also provides for the bundles to be cut from a roving or rovings of yarn immediately before depositing them onto the levelled ground.

Another variant of the method provides that, in order to restore a carriageway layer with sand-grit treated with hydraulic binders, the following steps be complied with:

rotary cutting-up then extraction of the layer;

transferring, in a mixer, and mixing the sand-grit with the binder and filament bundles of a length of less than 100 mm and consisting of at least 40 filaments each having an individual diameter lying between 5 and 25 μm and having been obtained by cutting at least one roving of yarns;

putting the mix in place on the carriageway.

Compared to the known processes and, in particular, to those which use a pneumatic means for transporting the fibres and for injecting them into inorganic granulates, the processes of the invention have the advantage of avoiding any segregation or dispersion of the fibres other than into the granulates. Thus contamination and losses are limited. Moreover, they enable a much more uniform distribution of the fibres to be obtained, thereby making it possible to control the quantity thereof.

The invention also proposes a stationary device for making up a mix of powders or granulates and textile glass fibres, which is intended to form grounds, layers or sublayers of terrains or carriageways which includes, especially, a continuous-yarn cutting machine arranged in the vicinity of a conveyor, a system for distributing the cut yarns over the conveyor which transports, especially, the powders or granulates as well as, possibly, downstream of the distributor of cut yarns, a distributor of powder or granulates which cover the cut yarns. This device enables, in particular, the process of the invention to be simply implemented in the immediate vicinity of the work-site for production of sports terrains or for construction of carriageways. Another device, a moving one in this case, is also proposed.

BRIEF DESCRIPTION OF THE DRAWINGS

The figures and the description which follow will enable the operation of the invention to be understood.

DESCRIPTION OF THE PREFERRED EMBODIMENTS

Figure 1:
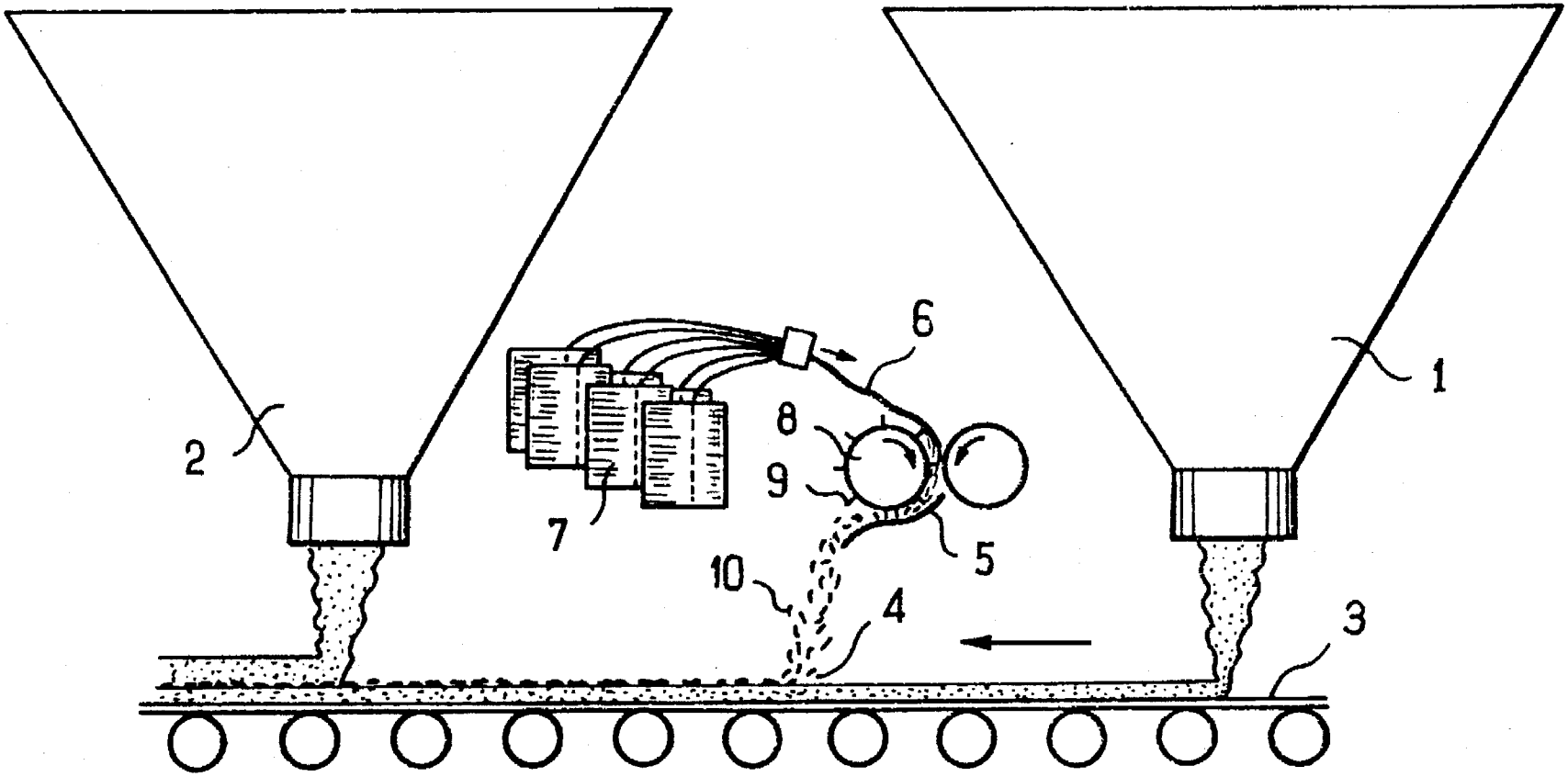
FIG. 1 represents the device enabling the process of the invention to be implemented within the framework of centralized making-up of the granulated material.

FIG. 1 illustrates a first centralized method for producing the mix between the granular or pulverulent material and the fibres.

When a terrain is constructed or when a road is built, a site is generally chosen, in its vicinity, at which all the materials to be employed during the construction will be made up. Should this be a road, it is there, for example, that the plant is often located. Lorries continually transport the made-up materials from the compounding site right to the moving work-site which, itself, follows the advance of the work over the terrain or over the road under construction.

A device for implementing a first process of the invention is installed on this site for compounding the materials. FIG. 1 shows the first part of the device, at which the procedure for compounding the product of the invention starts.

The figure shows two hoppers 1, 2 containing the pulverulent or granulated materials to be employed, for example, on the one hand, an ungraded sand originating from a pit near the site and a correcting sand, the latter, added in significant quantities, being—in the absence of fibres—necessary for providing the mix with the desired bearing capacity. A conveyor belt 3 has been installed beneath the hoppers, leading from one to the other. The hopper 1 deposits onto the conveyor a certain thickness of the material, such as ungraded sand. This sand then passes, at 4, under a machine 5 for cutting the glass yarns. This machine is supplied with yarn rovings 6 from several bobbins, such as 7, which are unwound from the inside. The machine 5 generally includes several rollers 8, at least one of which is equipped with cutters 9 which cut the set of rovings 6 into sections 10 of defined length. Each roving comprises a very large number of yarns, generally more than 400, for example 1200. The nature of the glass forming the fibres is not a factor determining the bearing capacity. It is only in special cases, for example under conditions of attack by binders, that it is advisable to substitute the usual E glass with a glass of a different composition.

In order to cut the yarns, the usual machines for cutting textile glass yarns are advantageously used. European Patent EP-B-0,040,145 proposes, for example, a machine intended to cut yarns into sections of a predetermined length and which comprises a rotary drum, the surface of which is smooth, and a second drum equipped with blades arranged perpendicularly to its periphery, the blades being fixed by their sole ends and their bases opposite their cutting edge remaining entirely free, while members ensure compression of the yarn.

During the tests, the lengths of rovings, once cut, broke up into as many bundles as the roving comprised yarns. The bundles, once cut, with a length of 25 mm, were therefore yarn segments each with the same number of filaments. It is to speed up the cutting of the yarns that the latter have been combined, before formation of bobbins, into rovings which comprise 80 yarns for example. It is these rovings which are unwound from bobbins, such as 7, and fed into the cutting/metering machine 5. The mass of a textile yarn per unit length is measured in tex. Here, each yarn was of 25 tex and each roving of 2400 tex. The diameter of the filaments was 11 μm. That is to say, each yarn comprised 48 filaments. The sizing of the filaments was chosen so as to promote not only the bonding between the filaments but also the sliding of the yarns with respect to each other, to protect them from various kinds of attack, especially chemical attack, and to prevent static electricity.

The filament bundles 10 are preferably deposited over the entire width of the sand transported by conveyor belt 3. After depositing the fibres, the materials pass under the hopper 2 where a quantity of sand, for example a correcting sand coming from a remote pit (but in this case, by virtue of the stabilizing effect of the fibres, in a minimum quantity) is deposited. Thus, by immediately covering the fibres, the dispersion is prevented from being disturbed.

At the exit of the conveyor belt 3, the materials fall into a mixer, not shown, where homogenization of the distribution of the fibres in the sand (and of the correcting sand if it was decided to add this to the local sand) is obtained, it also being in this mixer that the addition of hydraulic binder in a proportion of 3% and the adjustment of moisture content to a final value of from 10 to 12% are carried out in the case of a subgrade. A conveyor, for example a bucket conveyor, takes up the materials which are then stored in a hopper under which the lorries are loaded. They are transported to the moving work-site and will then be deposited onto the previously levelled ground.

Depending on the size of the work-site and on the skill of the workforce available, it may be advantageous instead to use, in place of a roving-cutting machine, to use on the work-site filament bundles already cut up, which it then suffices to feed at a constant rate before mixing them with the powders or with the granules, as described previously.

The above technique is particularly suitable for large work-sites, where the construction of a central unit for making up the materials is justified by the quantities to be made up and by the duration of the work-site. In the case of a localized work-site or when reinforcement has to be made on the material of the ground which itself preexists, or in the case of the repair of carriageways, it is of interest to implement the process of the invention directly on the site of use and, in this case, to carry out the fibre/granular-material mixing directly in the ground by virtue of techniques which pertain those of to agriculture.

The technique comprises three steps, preparing the ground, distributing the bundles and mixing. The preparation consists in levelling the ground and in depositing therein the granular materials coming from outside or, if by its nature it is suitable, in loosening it to the depth to be treated. The distribution of the bundles may be accomplished using precut yarns and, in this case, the distributing machine has attached to it a sowing device, or, alternatively, a moving cutting machine equipped with a device for uniformly distributing the bundles. As regards the mixing operation, this consists in tilling the ground to the chosen depth in order to distribute the fibres deposited beforehand on the surface. In order to do this, a harrow, or preferably a rotary machine such as a rotary cultivator of the ROTOVATOR type, is used. The three operations which require suitable apparatuses may be carried out separately or in a single operation with combined machines using a single means of movement (a tractor).

A variant of the previous method has been developed for repairing carriageway layers made of sand-grit treated with hydraulic binders. Here, the sand-grit particles are extracted, reducing them to their constituents granulated (the sand-grit particles) and powders (the pulverized binders) and they are mixed with the fibres of the invention, adding water and the new hydraulic binders before replacing the material at its original location.

The advantage in cutting the rovings of textile glass yarns directly, just before distribution, is that a precise amount of filament bundles in the granular mix is guaranteed. The roving-cutting machines, like the one in the document EP-B-0,040,145, in fact entrain them at a defined speed (the tangential speed of the rollers) and, since the quantity of bundles introduced over a given time is therefore always the same, all that is required to be done, in order for the percentage of filament bundles to remain stable, is for the speed of movement of the machine with respect to the ground or the output of the granulates to be constant, as is generally the case. It is also possible to slave the speed of rotation of the rollers of the cutting machine either to its speed of movement or, if it is immobile, to the output rate of the conveyor so as to guarantee, here too, the stability of the percentage of bundles.

The first method which has been described in detail applies, as it is, to the production of road or motorway sublayers and, more specifically, of subgrades, that is to say of the first layer deposited right on the levelled ground. The same method is easily adapted to the other road sublayers such as, for example, the foundation course, the latter resting directly on the subgrade, or to the base course.

The moving methods are more suitable for localized work-sites, where it is the granular material of the ground itself which needs to be stabilized, and for the retreatment of damaged carriageways.

In order to implement the method of restoring damaged carriageways, a moving machine is preferably used whose functions are, in succession: extracting the existing layer after rotary cutting, adding the fibre and binders and then mixing in a mixer, and, finally, putting the mixed product into place on the ground.

The function of the methods according to the invention is to increase the "bearing capacity" of the powder or of the granular material used in the grounds. The traditional method for improving the bearing capacity of a given material, such as ungraded sand, consists in adding to it specified quantities of a sand of well-defined particle size distribution, which is called a correcting sand. The addition of fibres according to the invention makes it possible to decrease significantly or even, in some cases, to omit the addition of correcting sand in order to achieve a given bearing capacity.

The bearing capacity of the sand treated with a hydraulic binder is evaluated using a standardized quantity (NF-P-98 231.4), the immediate bearing capacity factor (I.B.C.F). The test for determining it consists in pressing down on a ram of specified shape in order to press it to a given depth (2.5 mm) into the material to be tested. The measurement is that of the force necessary to achieve this pressing-in, this being proportional to the pressure on the face of the ram.

Tests have been performed with examples of sand from the Paris region called "very-fine sand" to which was added from 1 to 6% of hydraulic binder and from 0 to 10% of correcting sand of a particle size distribution lying between 0 and 3 mm. In all cases, it was found that, by mixing from 0.01% to 0.5% of bundles of glass fibres of a respective-individual diameter of 5 μm and 25 μm with the sand with its binder, the improvement in the I.B.C.F. was significant, and this was so irrespective of the amount of correcting sand.

Thus, in the case of 10% of corrector and 6% of binder, the I.B.C.F., which was 25 without fibres, goes to 40 if 0.05% by weigher of fibres (with respect to the dry starting materials) is added. In general, the fibres enable the I.B.C.F. to be increased by at least 10 points.

Depending on the layer to be reinforced and depending on its function, the quantities of hydraulic binder when this is present, are of a greater or lesser amount, if they are zero or remain low, it is suitable to use filament bundles made from the usual glass intended for reinforcing plastics or for producing textiles, for example glass yarns of the STABIFIL type, made from a conventional glass for the reinforcing fibre called "E glass".

If the quantities of hydraulic binder are greater, other compositions are used, such as, in particular, that known thanks to U.S. Pat. No. 3,861,926 which provides the composition of fibres of the CEM-FIL type. Likewise, instead of changing composition, but in particular supplementing the latter, it is known to use alkali-resisting sizes which protect the individual filaments or at least slow down their attack by basic solutions.

The hydraulic binders have a well-known characteristic, their shrinkage during their hardening ("setting"). In order for these binders to remain effective, it is necessary for them to remain compact and for cracking in them to be absent, or at the very least to remain limited.

In order to test the cracking resistance of sand with binders reinforced in various ways, the so-called "ring" test, as described in the AFNOR P 16-434 standard, is used, the test consisting in determining the time to form a crack and determining its width on ring-shaped specimens of normal paste, these being kept under defined conditions. The specimen, consisting of the mix of reinforced sand and the binder, is cast into a cylindrical mould (127 mm diameter) having a vertical axis and which includes a coaxial cylindrical steel core (90 mm diameter).

The specimens are kept in a humid cabinet before demoulding and in air after demoulding, demoulding taking place after 24 hours. This is achieved by separating the two halves of the mould from each other. The specimen is kept with its core.

Two measurements are carried out on 3 identical specimens for a given material. The first consists in noting the time elapsed between the moment of demoulding and that when a crack occurs, the second consisting in observing the variation of the width of the cracks over time. The test report always gives the three observed values.

The tests were performed with two different road binders, both being based on blast furnace slag, at more than 80%; one, LIGEX, uses as active element quick lime (6%) with anhydrite (4%), and the other, CLK 45, and a clinker with 3% of fillers.

The formulation adopted for the road sand/binder mix is that of the NF-EN 1961 (March 1990) standard.

As regards the reinforcing glass fibres, these were either STABI-FIL or CEM-FIL (alkali resisting), in both cases in the form of a roving of 2400 tex with filaments of 14 μm diameter, the rovings being chopped into 6 or 25 mm lengths. The fibre content of the sand was respectively 0.1 and 0.2%.

Figure 2:
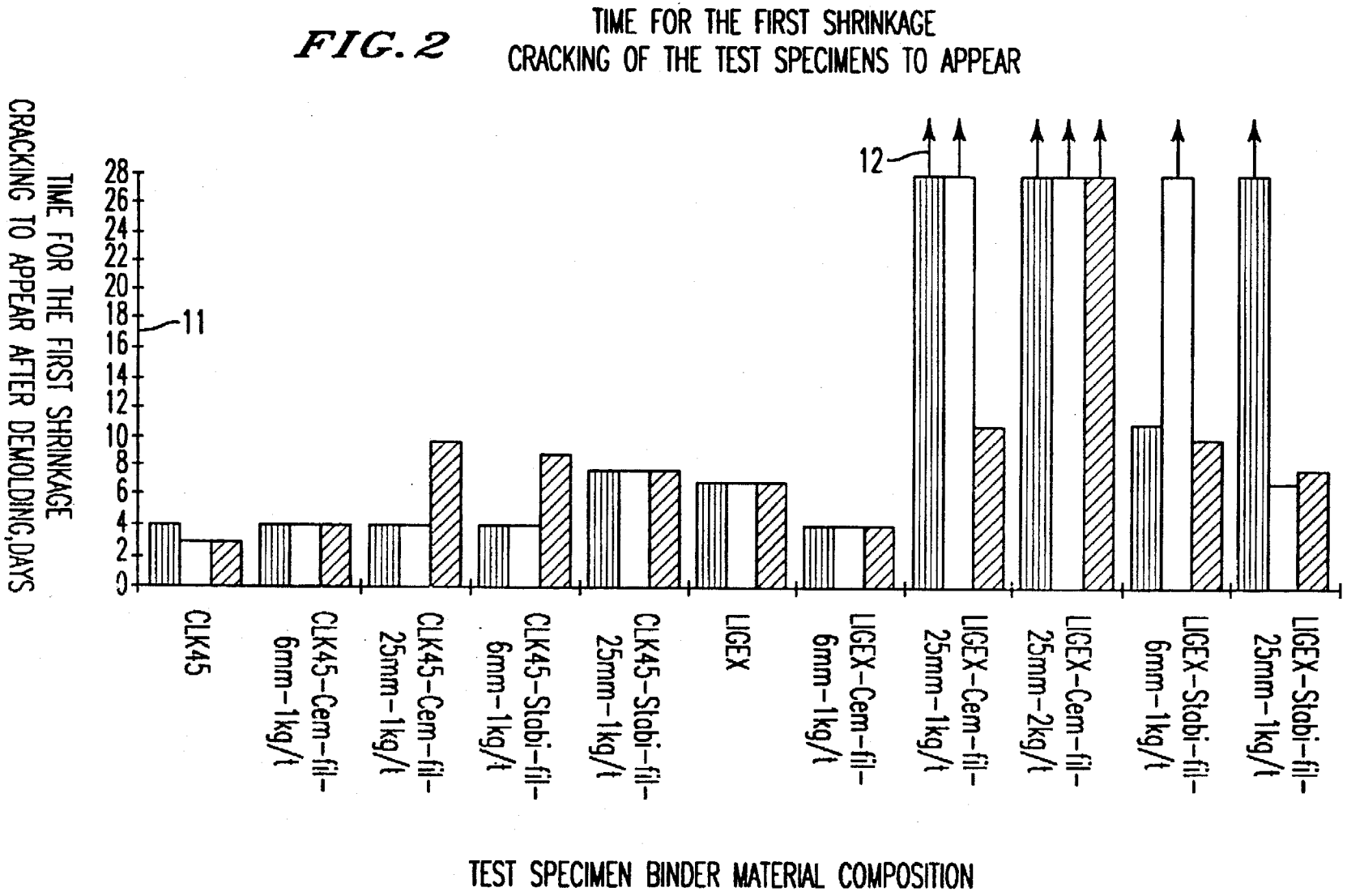
FIGS. 2 and 3 show comparative test results on the cracking of sand with hydraulic binders, respectively: times for the first shrinkage cracking (FIG. 2) and width of the cracks after 28 days (FIG. 3).
Figure 3:
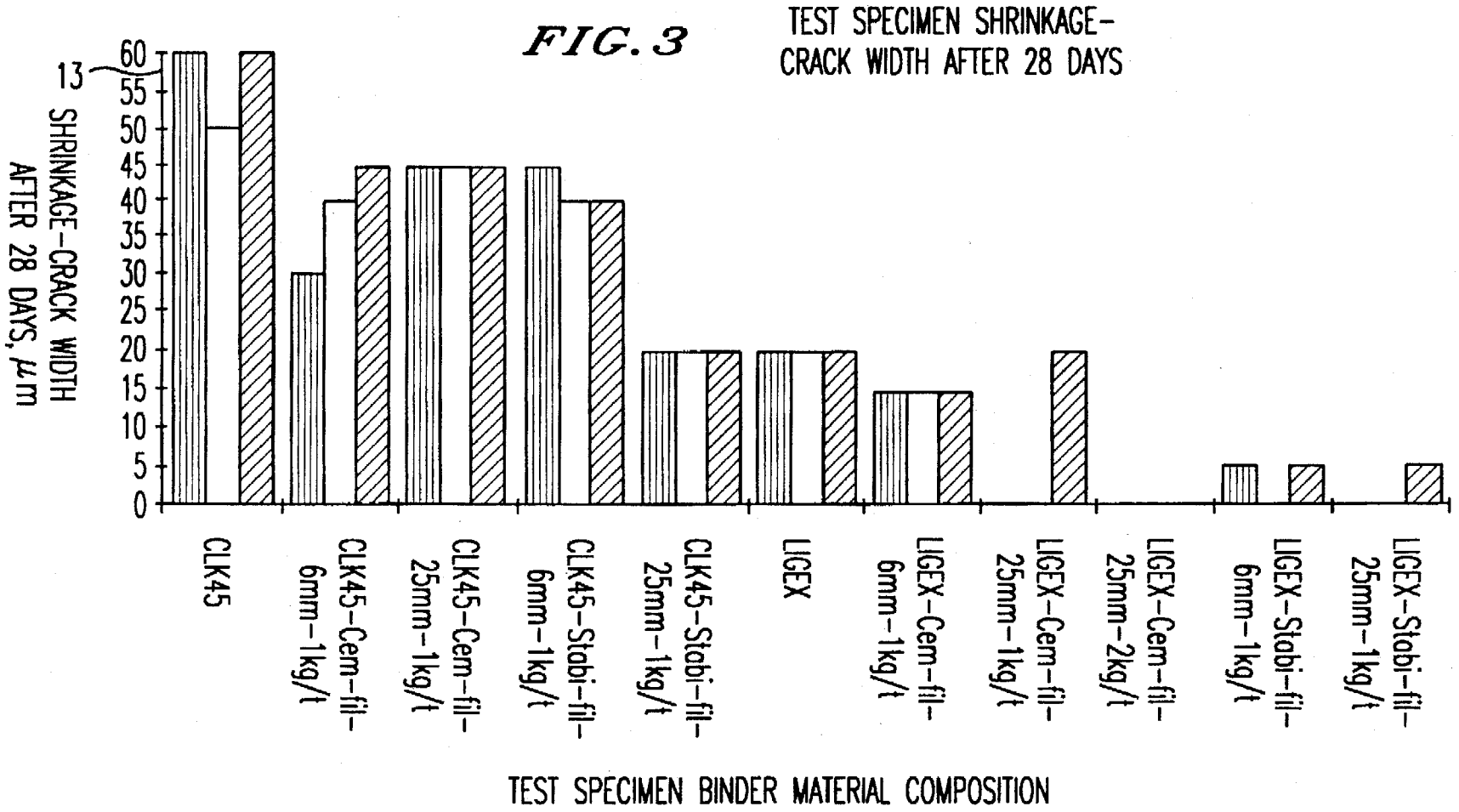

The results are shown in FIG. 2 for the time before appearance of the first crack and FIG. 3 for its width. For each composition, the three results for the three specimens produced are shown. FIG. 2 shows, at 11, the number of days after which the crack appeared.

The arrows 12 indicate that, after the twenty-fourth day, no crack was visible.

The results show that, with the LIGEX binder, the fibres, whatever these are, improve the bound sand since they always delay the appearance of cracks and even, often, in half of the cases, prevent it, since it is assumed that, after 28 days, the binder has finished shrinking. With the CLK 45 binder, the improvement, although still present, is less significant.

Regarding the width of the crack openings (FIG. 3 in which the width of the cracks in μm is indicated at 13), the results are consistent with the previous ones: apart from one exception, with the LIGEX binder, the fibres always improve the situation, the cracks being narrower (or absent). With CLK 45, the situation, which is very bad without fibres, is always improved by them.

These tests thus show that not only do the fibres of the invention improve the integrity of the grounds but that, in addition, they prevent or even eliminate the appearance of cracks and/or decrease their severity.

The technique of the invention makes it possible to improve the mechanical properties, in particular the bearing capacity of the grounds, the sublayers of which are based on powders or granulates, such as, for example, pulverulent natural substances, including organic products. This technique is particularly advantageous for the use of industrial by-products. Thus, for example, it makes it possible to use, as sublayers, slag which results from the manufacture of metals from their original ores, like the slag from blast furnaces. In this case, the addition of less than 0.1% of textile glass filaments combined into 40 or more enables the pulverulent substance to be rendered sufficiently stable in order to impart to it the stability necessary for the production of sublayers for roads or various terrains, sports terrains, racecourses, fairgrounds, etc.

Likewise, incineration ash or fly ash, in particular aluminosilicate fly ash, which are by-products of industry and which generally serve just to fill up pits, may, thanks to the invention, be used and thus be rendered commercially valuable. In general, any powdery or granulated, organic or inorganic, substance, irrespective of its origin, whether natural or industrial, is amenable to the method of the invention. This is the case, in particular, for household-waste treatment residues.

In the case of the repair of damaged roads, the technique of the invention enables the sand-grit treated with hydraulic binders to be reused, thereby limiting the external supply of new materials.

What is claimed as new and desired to be secured by Letters Patent of the United States is:

1. Granular material intended for the production of ground layers, terrain or carriageway layers or sublayers and including a mix based on inorganic or organic powders or granulates and on fibres, wherein the fibres are inorganic fibres, the fibres are filaments in the form of bundles, each bundle having a length less than 100 mm and consisting of at least 40 filaments, each filament having an individual diameter lying between 5 and 25 μm.

2. Granular material according to claim 1, wherein the fibres are glass fibres.

3. Material according to one of claims 1 or 2, wherein the amount by weight of the filament bundles in the mix lies between 0.01% and 0.5%.

4. Material according to claim 2, wherein the bundles are cut from textile glass yarns, the filaments of which have a diameter lying between 10 and 16 μm.

5. Material according to claim 2, wherein the glass fibres are alkali-resistant.

6. Method for producing the mix of inorganic or organic granulates or powder and of fibres according to claim 2, comprising the following steps:

depositing of a layer of powder or granulates onto a transporter;

depositing, by gravity, onto the layer of powder or granulates, of filament bundles of a length less than 100 mm and consisting of at least 40 filaments, each having an individual diameter lying between 5 and 25 μm and obtained by cutting at least one roving of glass yarns;

and, finally, mixing the powders or granulates with the filament bundles.

7. Method of making up a mix of inorganic or organic granulates or powder and of fibres according to claim 6, wherein the cutting of the filament bundles is carried out immediately before immediately before the step of depositing onto the layer of powder or granulates they are deposited.

8. Method according to claim 6, further comprising the step of covering the filament bundles with a layer of granulates or powder, before the final mixing step.

9. Method for producing the mix of inorganic or organic granulates or powder and of fibres according to claim 2, comprising the following steps:

depositing filament bundles of a length less than 100 mm, consisting of at least 40 filaments, each filament having an individual diameter lying between 5 and 25 μm and having been obtained by cutting at least one roving of yarns; and mixing the powders or granulates and the filament bundles by passage of a work-site machine of the rotary-cultivator type.

10. Method according to claim 9, wherein the step of depositing filament bundles is performed by a work-site machine of the sower type.

11. Method according to claim 9, wherein the cutting of the filament bundles from at least one roving of yarns is carried out immediately before the precut filament bundles are deposited onto the levelled ground.

12. Device for implementing the method of claim 11, including a continuous-yarn cutting machine installed on a moving machine and a system for distributing the cut yarns transversely with respect to the movement of the machine, as well as a work-site machine of the rotary-cultivator type, its movement and that of the cutting machine being either linked or not.

13. Material according to claim 1, wherein the bundles have a length lying between 20 and 50 mm.

14. Material according to claim 1, wherein the granulates are selected from sand and mixtures of sand with a variable quantity of hydraulic binder.

15. Material according to claim 1, wherein the powder essentially comprises industrial by-products.

16. Material according to claim 1, wherein the granulates are sand-grit particles treated with hydraulic binders.

17. Device for making up a mix of powder or granulates and of textile glass fibres intended to form grounds, terrain or carriageway layers or sublayers, including a continuous-yarn cutting machine located in the vicinity of a conveyor system for distributing cut yarns onto the conveyor which transports the powder or granulates.

18. Device according to claim 17, further including downstream of the cut-yarn distributor, a powder or granulate distributor which cover the cut yarns.

19. Method for restoring a carriageway layer with sand-grit treated with hydraulic binders, comprising the following steps:

rotary cutting and then extracting the layer;

transferring into a mixer and mixing the sand-grit with the binder and filament bundles of a length of less than 100 mm and consisting of at least 40 filaments, each filament having an individual diameter lying between 5 and 25 μm, and having been obtained by cutting at least one roving of yarns, to produce a mix; and putting the mix into place on the carriageway.

* * * * *